US009753473B2

(12) United States Patent
Tan et al.

(10) Patent No.: US 9,753,473 B2
(45) Date of Patent: Sep. 5, 2017

(54) TWO-STAGE LOW-DROPOUT FREQUENCY-COMPENSATING LINEAR POWER SUPPLY SYSTEMS AND METHODS

(71) Applicant: NORTHROP GRUMMAN SYSTEMS CORPORATION, Falls Church, VA (US)

(72) Inventors: Fang Dong Tan, Irvine, CA (US); Jeff Zee, Los Angeles, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 698 days.

(21) Appl. No.: 13/633,568

(22) Filed: Oct. 2, 2012

(65) Prior Publication Data

US 2014/0091775 A1 Apr. 3, 2014

(51) Int. Cl.
*G05F 1/575* (2006.01)
*G05F 1/563* (2006.01)

(52) U.S. Cl.
CPC ..... *G05F 1/575* (2013.01); *G05F 1/563* (2013.01)

(58) Field of Classification Search
CPC . G05F 1/56; G05F 1/565; G05F 1/575; G05F 1/10; G05F 1/46; G05F 1/461; G05F 1/467; G05F 1/563; H03F 1/0227; H03F 2200/451; H03F 2200/504
USPC ..... 323/269–277, 279–281
See application file for complete search history.

(56) References Cited

U.S. PATENT DOCUMENTS 6,075,351 A * 6/2000 Benes ..... 323/280
6,459,246 B1 * 10/2002 Roo ..... 323/270
6,465,994 B1 10/2002 Xi
6,522,112 B1 * 2/2003 Schmoock et al. ..... 323/280
6,710,583 B2 * 3/2004 Stanescu et al. ..... 323/280
6,765,374 B1 * 7/2004 Yang et al. ..... 323/280
7,205,827 B2 * 4/2007 Leung ..... G05F 1/575 323/280
7,612,547 B2 * 11/2009 Renous ..... 323/280
7,902,801 B2 3/2011 Mandal
(Continued)

FOREIGN PATENT DOCUMENTS

JP 4947865 5/1974
JP 501353 1/1975
(Continued)

OTHER PUBLICATIONS

Office Action issued Apr. 5, 2016 for corresponding JP 2015-535719; received from foreign associate on May 9, 2016.

*Primary Examiner* — Timothy J Dole
*Assistant Examiner* — Ivan Laboy Andino
(74) *Attorney, Agent, or Firm* — Tarolli, Sundheim, Covell & Tummino LLP

(57) ABSTRACT

Aspects of the present invention include a low-dropout (LDO) linear power supply system. The system includes a pass-element configured to generate an output voltage at an output based on an input voltage. The system also includes a compensation amplifier stage coupled to the output and configured to provide frequency compensation and provide a desired frequency response of the output voltage. The system further includes a gain amplifier stage interconnecting the compensation amplifier stage and the pass-element and configured to provide DC gain scaling to generate the output voltage substantially proportional to the input voltage within a given range of the input voltage.

13 Claims, 2 Drawing Sheets

(56) References Cited

U.S. PATENT DOCUMENTS

| | | | | |
|---|---|---|---|---|
| 7,919,954 | B1 * | 4/2011 | Mannama et al. | 323/272 |
| 2002/0130646 | A1 | 9/2002 | Zadeh et al. | |
| 2005/0189930 | A1 * | 9/2005 | Wu et al. | 323/280 |
| 2006/0273771 | A1 * | 12/2006 | van Ettinger | G05F 1/575 323/273 |
| 2007/0241731 | A1 * | 10/2007 | van Ettinger | G05F 1/575 323/280 |
| 2008/0157735 | A1 | 7/2008 | Liu et al. | |
| 2009/0128107 | A1 * | 5/2009 | Wang | G05F 1/575 323/280 |
| 2010/0295524 | A1 | 11/2010 | Sicard | |
| 2011/0029266 | A1 | 2/2011 | Lee | |
| 2011/0101936 | A1 | 5/2011 | Wang | |
| 2011/0193540 | A1 | 8/2011 | Dasgupta | |

FOREIGN PATENT DOCUMENTS

| | | | |
|---|---|---|---|
| JP | 2004180407 | A | 6/2004 |
| JP | 2004362250 | A | 12/2004 |
| JP | 2005243032 | A | 9/2005 |
| JP | 2010244255 | A | 10/2010 |
| JP | 2010259154 | A | 11/2010 |
| JP | 2011039578A | A | 2/2011 |

* cited by examiner

TWO-STAGE LOW-DROPOUT FREQUENCY-COMPENSATING LINEAR POWER SUPPLY SYSTEMS AND METHODS

TECHNICAL FIELD

The present invention relates generally to electronic circuits, and specifically to two-stage low-dropout linear power supply systems and methods.

BACKGROUND

There is an ever increasing demand for power conversion and regulation circuitry to operate with increased efficiency. One such type of regulator circuit is known as a low-dropout (LDO) linear power supply (linear regulator). An LDO linear power supply can be characterized as a DC/DC linear voltage regulator that can operate with a very small differential between the input voltage and the output voltage. LDO power supplies can exhibit a number of advantages over typical linear power supplies, in that an LDO linear power supply can typically operate with a lower minimum operating voltage and can typically have a higher efficiency operation and lower heat dissipation. General challenges for an LDO design can include ensuring low drop-out and stability over a wide range of load and output capacitance values.

SUMMARY

One aspect of the present invention includes a low-dropout (LDO) linear power supply system. The system includes a pass-element configured to generate an output voltage at an output based on an input voltage. The system also includes a compensation amplifier stage coupled to the output and configured to provide frequency compensation and provide a desired frequency response of the output voltage. The system further includes a gain amplifier stage interconnecting the compensation amplifier stage and the pass-element and configured to provide DC gain scaling to generate the output voltage substantially proportional to the input voltage within a given range of the input voltage.

Another embodiment of the present invention includes an LDO linear power supply system. The system includes a pass-element configured to generate an output voltage at an output based on an input voltage. The system also includes a compensation amplifier stage coupled to the output and configured to provide frequency compensation and provide a desired frequency response of the output voltage. The system also includes a gain amplifier stage interconnecting the compensation amplifier stage and the pass-element and configured to provide DC gain scaling to generate the output voltage substantially proportional to the input voltage within a given range of the input voltage. The system further includes a capacitor and an associated equivalent series resistor (ESR) coupled to the output to provide output filtering of the output voltage.

Another embodiment of the present invention includes an integrated circuit (IC) chip comprising an LDO linear power supply system. The system includes a pass-element configured to generate an output voltage at an output based on an input voltage. The system also includes a compensation amplifier stage coupled to the output and comprising a compensation operational amplifier (OP-AMP) configured to generate a stabilization voltage in response to a feedback voltage associated with the output voltage and a reference voltage. The compensation amplifier stage can be configured to provide frequency compensation and provide a desired frequency response of the output voltage. The system also includes a gain amplifier stage interconnecting the compensation amplifier stage and the pass-element and comprising a gain OP-AMP configured to receive the stabilization voltage at a first input and to generate a control voltage at an output. The control voltage can be provided to control the pass-element at a control input, the gain amplifier stage being configured to provide DC gain scaling to generate the output voltage substantially proportional to the input voltage. The system further includes terminals configured to receive a capacitor and an associated equivalent series resistor (ESR) coupled to the output external to the IC to provide output filtering of the output voltage.

DETAILED DESCRIPTION

The present invention relates generally to electronic circuits, and specifically to two-stage low-dropout (LDO) linear power supply systems and methods. The LDO linear power supply system includes a pass element that is configured to generate an output voltage at an output of the LDO linear power supply system based on an input voltage. The output voltage can be substantially proportional to the input voltage within a given range of the input voltage, above which the output voltage can be approximately constant based on saturation of the pass element. As an example, the pass element can be configured, within the general framework, as an N-channel metal oxide semiconductor field-effect transistor (MOSFET), a P-channel MOSFET, an NPN bipolar junction transistor (BJT), a PNP BJT, or as a Darlington pair of transistors (e.g., NPN or PNP BJTs).

The LDO linear power supply system also includes a first amplifier stage configured as a compensation amplifier stage that is coupled to the output of the LDO linear power supply system. As an example, the compensation amplifier stage includes an inverting operational amplifier (OP-AMP) and a plurality of resistive-capacitive (RC) networks. The inverting OP-AMP is configured to generate a stabilization voltage based on a feedback voltage associated with the output voltage and a reference voltage. The RC networks can include an RC feed-forward network coupled between the output and a first input of the compensation OP-AMP and an RC feedback network coupled between the first input and an output of the compensation OP-AMP. The RC feed-forward and feedback networks can cooperate to affect the frequency response of the output voltage and to provide substantially rapid transient response of the stabilization voltage with step loads.

The LDO linear power supply system also includes a second amplifier stage configured as a gain amplifier stage that interconnects the pass element and the compensation amplifier stage. Therefore, the gain amplifier stage operates to buffer the pass element from the stabilization voltage output from the inverting OP-AMP. For example, the gain amplifier stage includes a gain OP-AMP configured to receive the stabilization voltage and to generate a control voltage having a magnitude that is proportional to the stabilization voltage. The control voltage is provided to a control input of the pass element to operate the pass element in one of a linear mode and a saturation mode, thus allowing the output voltage to be substantially proportional to the input voltage through a given range of the input voltage.

Figure 1:
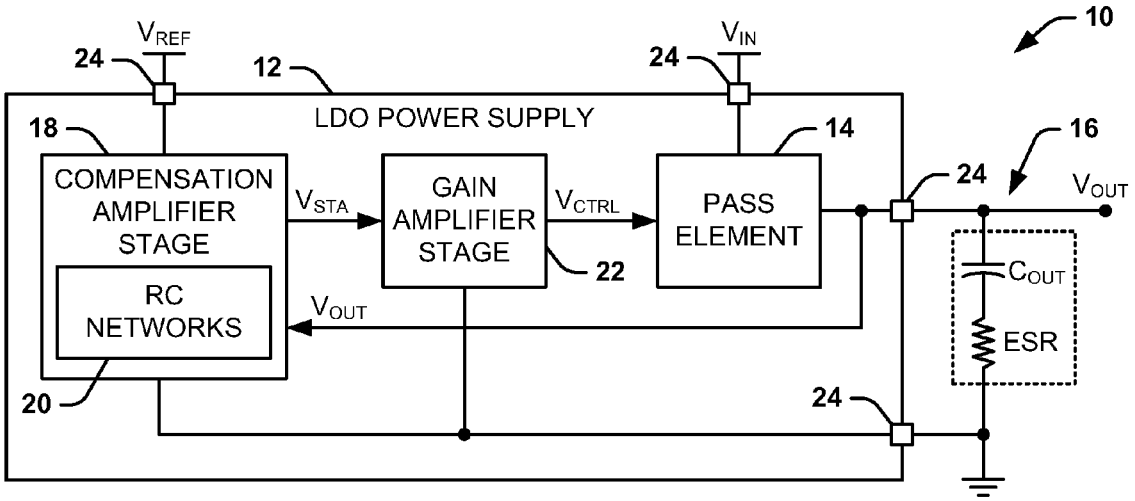
FIG. 1 illustrates an example of a low-dropout (LDO) linear power supply system in accordance with an aspect of the invention.

FIG. 1 illustrates an example of a low-dropout (LDO) linear power supply system 10 in accordance with an aspect of the invention. The LDO linear power supply 10 is configured to generate an output voltage $V_{OUT}$ that has a magnitude that is substantially proportional to an input voltage $V_{IN}$ through a given range of the input voltage $V_{IN}$. As an example, in response to the input voltage $V_{IN}$ increasing to a magnitude that is greater than threshold magnitude, the output voltage $V_{OUT}$ may be provided at an approximately constant maximum magnitude. The LDO linear power supply system 10 can be implemented in any of a variety of applications in which the output voltage $V_{OUT}$ is to be provided at a substantially stable magnitude based on the input voltage $V_{IN}$, as described in greater detail herein.

The LDO linear power supply system 10 includes an LDO linear power supply 12, which can be arranged in an integrated circuit (IC) chip. The LDO linear power supply 12 includes a pass element 14, which can be configured as a transistor. The pass element 14 interconnects the input voltage $V_{IN}$ and the output voltage $V_{OUT}$ at an output 16. For example, the pass element 14 can be configured as an N-channel metal oxide semiconductor field-effect transistor (MOSFET), a P-channel MOSFET, an NPN bipolar junction transistor (BJT), a PNP BJT, or as a Darlington pair of transistors (e.g., NPN or PNP BJTs). As an example, the pass element 14 can be implemented as a P-channel MOSFET, a PNP BJT, or as a Darlington pair comprising a set of PNP BJTs to provide the output voltage $V_{OUT}$ as a negative voltage.

The LDO linear power supply 12 also includes a compensation amplifier stage 18 that is coupled to the output 16. The compensation amplifier stage 18 is configured to generate a stabilization voltage $V_{STA}$ that is associated with the output voltage $V_{OUT}$ at the output 16. As an example, the compensation amplifier stage 18 includes a compensation operation amplifier (OP-AMP) that is configured to generate the stabilization voltage $V_{STA}$ at an output based on a reference voltage $V_{REF}$ and a feedback voltage that is associated with the output voltage $V_{OUT}$. In addition, the compensation amplifier stage 18 includes a plurality of resistive-capacitive (RC) networks 20 that cooperate to affect a frequency response of the stabilization voltage $V_{STA}$, and thus the output voltage $V_{OUT}$, and to provide substantially rapid transient response of the stabilization voltage $V_{STA}$.

The stabilization voltage $V_{STA}$ is provided to a gain amplifier stage 22 that interconnects the pass element 14 and the compensation amplifier stage 18. The gain amplifier stage 22 is configured to generate a control voltage $V_{CTRL}$ that is provided to a control input of the pass element 14, such that the pass element 14 can be operated in a linear region through the given range of magnitudes of the input voltage $V_{IN}$. As an example, the gain amplifier stage 22 includes a gain OP-AMP that generates the control voltage $V_{CTRL}$ based on the stabilization voltage $V_{STA}$. For example, the control voltage $V_{CTRL}$ can be substantially proportional to the stabilization voltage $V_{STA}$. Therefore, the control voltage $V_{CTRL}$ can exhibit substantially the same frequency response and substantially rapid transient response as the stabilization voltage $V_{STA}$ with step loads.

The LDO linear power supply 12 further includes terminals 24, such as contact terminals, leads, solder pads, or a variety of other external electrical connection points. In the example of FIG. 1, the terminals 24 are configured to receive the reference voltage $V_{REF}$ and the input voltage $V_{IN}$, and to provide the output voltage $V_{OUT}$ and a connection to a low-voltage rail, demonstrated in the example of FIG. 1 as ground. The terminals 24 that provide the output voltage $V_{OUT}$ and the connection to ground can also be configured to receive an output capacitor $C_{OUT}$ and an equivalent series resistor (ESR) connected to the LDO linear power supply 12 (e.g., external to the IC package). As an example, the ESR can correspond to a parasitic resistance associated with the output capacitor $C_{OUT}$.

By implementing the LDO linear power supply system 10 as a two-stage amplifier system, the LDO linear power supply system 10 can be implemented as a circuit having a relatively simple design but improved capability over typical LDO linear power supply systems. As one example, typical LDO linear power supply systems utilize both output voltage filtering and frequency compensation (i.e., loop shaping) via the ESR provided by an external capacitor and external resistor connection. Such requirements of output voltage filtering and frequency compensation for an LDO linear power supply system can conflict with each other, such that zero of the of the respective output capacitor is implemented for loop stability while the ESR that includes the respective output capacitor is implemented for output filtering. Such a requirement conflict can result in a very narrow region of stability with respect to output current as a function of ESR, thus creating a stability region typically known as a "Tunnel of Death", outside of which the stability of the LDO linear power supply system is compromised. The LDO linear power supply system 10 overcomes the narrow "Tunnel of Death" problem by separating the functions of output filtering and frequency compensation, such that the output capacitor $C_{OUT}$ and the ESR provide output filtering of the output voltage $V_{OUT}$, while the compensation amplifier stage 18 provides frequency compensation of the LDO linear power supply system 10 independently of the output capacitor $C_{OUT}$ (i.e., without implementing the zero of the output capacitor $C_{OUT}$). As a result, the LDO linear power supply system 10 can exhibit much greater stability over a wider range of component values of the output capacitor $C_{OUT}$, and thus the ESR, without compromising the output filtering function of the output capacitor $C_{OUT}$ and the desired frequency response.

In addition, typical LDO linear power supply systems implement only a single amplifier stage that interconnects the feedback associated with the output voltage with the control input of an associated pass element, thus driving the pass element with a signal that is based more directly on the output voltage. Therefore, the robustness of typical LDO linear power supply systems can also be compromised over variations of load with respect to cross-over frequency, gain and phase margins, and power supply rejection of the typical LDO linear power supply. By incorporating both the compensation amplifier stage 18 and the gain amplifier stage 22 in the two-stage implementation, the gain amplifier stage 22 provides sufficient buffering between the pass element 14 and the frequency compensation of the output voltage $V_{OUT}$ to decouple a loading effect on the pass element 14. Described another way, the compensation amplifier stage 18 provides buffering between the output voltage $V_{OUT}$ and the DC gain scaling provided by the gain amplifier stage 22. Therefore, the LDO linear power supply system 10 can maintain sufficient cross-over frequency, gain and phase margins, and power supply rejection over a variety of loading conditions. In addition, by implementing two amplifier stages, the LDO linear power supply system 10 can maintain a relatively simple design while achieving substantially improved performance relative to typical LDO linear power supply systems. Furthermore, the simplistic design of the LDO linear power supply system 10 is such that any of a variety of pass-elements can be accommodated with minimal variation, such that the LDO linear power supply system 10 can be flexible with respect to the circuit components implemented therein to provide ultra-low-dropout capability in generating the output voltage $V_{OUT}$.

Figure 2:
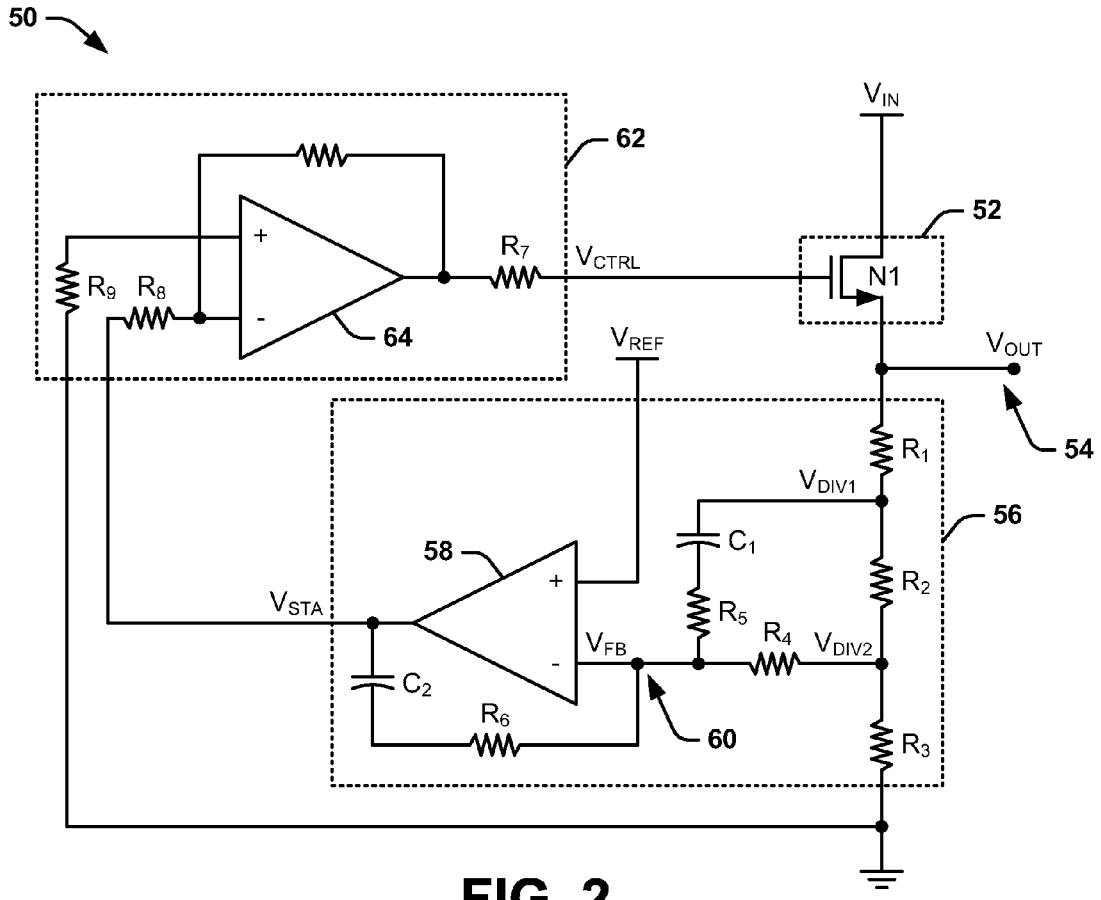
FIG. 2 illustrates an example of an LDO linear power supply circuit in accordance with an aspect of the invention.

FIG. 2 illustrates an example of an LDO linear power supply circuit 50 in accordance with an aspect of the invention. The LDO linear power supply circuit 50 can be included in an IC chip (i.e., IC package). The LDO linear power supply circuit 50 can correspond to the LDO linear power supply 12 in the example of FIG. 1. Therefore, reference can be made to the example of FIG. 1 in the following description of the example of FIG. 2.

The LDO linear power supply circuit 50 is configured to generate an output voltage $V_{OUT}$ that has a magnitude that is substantially proportional to an input voltage $V_{IN}$ through a given range of the input voltage $V_{IN}$. As an example, in response to the input voltage $V_{IN}$ increasing to a magnitude that is greater than threshold magnitude, the output voltage $V_{OUT}$ may be provided at an approximately constant maximum magnitude. The LDO linear power supply circuit 50 can be implemented in any of a variety of applications in which the output voltage $V_{OUT}$ is to be provided at a substantially stable magnitude based on the input voltage $V_{IN}$, as described in greater detail herein.

The LDO linear power supply circuit 50 includes a pass element 52, demonstrated in the example of FIG. 2 as an N-channel MOSFET (N-FET) $N_1$. The N-FET $N_1$ is coupled to the input voltage $V_{IN}$ at a drain and an output 54 to provide the output voltage $V_{OUT}$ via a source. In the example of FIG. 2, the N-FET $N_1$ receives a control voltage CTRL at a gate to control the N-FET $N_1$ in a linear region through a given range of magnitudes of the input voltage $V_{IN}$.

The LDO linear power supply circuit 50 also includes a compensation amplifier stage 56 that is coupled to the output 54. The compensation amplifier stage 56 includes a compensation OP-AMP 58 that is configured to generate a stabilization voltage $V_{STA}$ based on a reference voltage $V_{REF}$ at a non-inverting input and a feedback voltage $V_{FB}$ at an inverting input coupled to a node 60. Therefore, the compensation OP-AMP 58 is configured as an inverting OP-AMP to provide for fast transient response for slew of the compensation OP-AMP 58. The compensation amplifier stage 56 also includes a set of resistors $R_1$, $R_2$, and $R_3$ that interconnect the output 54 and a low-voltage rail, demonstrated in the example of FIG. 2 as ground. The resistors $R_1$ and $R_2$ form a first voltage-divider to generate a voltage $V_{DIV1}$ and the resistors $R_2$ and $R_3$ form a second voltage-divider to generate a voltage $V_{DIV2}$. The feedback voltage $V_{FB}$ is generated at the node 60 based on the voltage $V_{DIV1}$ via a resistive-capacitive feed-forward network formed by a capacitor C1 and a resistor $R_5$, based on the voltage $V_{DIV2}$ via a resistor $R_4$, and based on the stabilization voltage $V_{STA}$ via a resistive-capacitive feedback network formed by a capacitor C2 and a resistor $R_6$. Therefore, the feedback voltage $V_{FB}$ is generated based on the output voltage $V_{OUT}$ and the stabilization voltage $V_{STA}$. The compensation OP-AMP 58 thus acts as an error amplifier to generate the stabilization voltage $V_{STA}$ to provide frequency compensation of the LDO linear power supply circuit 50 to affect the frequency response of the stabilization voltage $V_{STA}$, and thus the output voltage $V_{OUT}$, and to provide substantially rapid transient response of the stabilization voltage $V_{STA}$.

The stabilization voltage $V_{STA}$ is provided to a gain amplifier stage 62 that interconnects the pass element 52 and the compensation amplifier stage 56. The gain amplifier stage 62 includes a gain OP-AMP 64 that is configured to generate a control voltage $V_{CTRL}$ via a resistor $R_7$. The control voltage $V_{CTRL}$ is provided to a gate of the N-FET $N_1$, such that the N-FET $N_1$ can be operated in a linear region through the given range of magnitudes of the input voltage $V_{IN}$. In the example of FIG. 2, the gain OP-AMP 64 receives the stabilization voltage $V_{STA}$ at an inverting input of the gain OP-AMP 64 via a resistor $R_8$ and is coupled to ground at a non-inverting input via a resistor $R_9$. In addition, a feedback resistor $R_{10}$ interconnects an output and the inverting input of the gain OP-AMP 64. Therefore, the gain OP-AMP 64 is configured to provide DC gain scaling of the stabilization voltage $V_{STA}$ in generating the control voltage $V_{CTRL}$ and to provide buffering to decouple the load impedance from impacting the frequency response of the compensation OP-AMP 58. As a result, the control voltage $V_{CTRL}$ can exhibit substantially the same frequency response and substantially rapid transient response as the stabilization voltage $V_{STA}$. Accordingly, the N-FET $N_1$ can be operated in a linear region through a given range of magnitudes of the input voltage $V_{IN}$ based on the control voltage $V_{CTRL}$.

It is to be understood that the LDO linear power supply circuit 50 is not intended to be limited to the example of FIG. 2. For example, the LDO linear power supply circuit 50 can be implemented with additional or alternative circuit components to achieve substantially the same desired effects with respect to the compensation stage 56 and/or the gain stage 62. In addition, the pass element 52 is not limited to being implemented as an N-FET, but could instead be implemented as an NPN BJT or an NPN Darlington pair, such that pass element 52 can be controlled by a current provided through the resistor $R_7$. Accordingly, the LDO linear power supply circuit 50 can be configured in a variety of ways.

Figure 3:
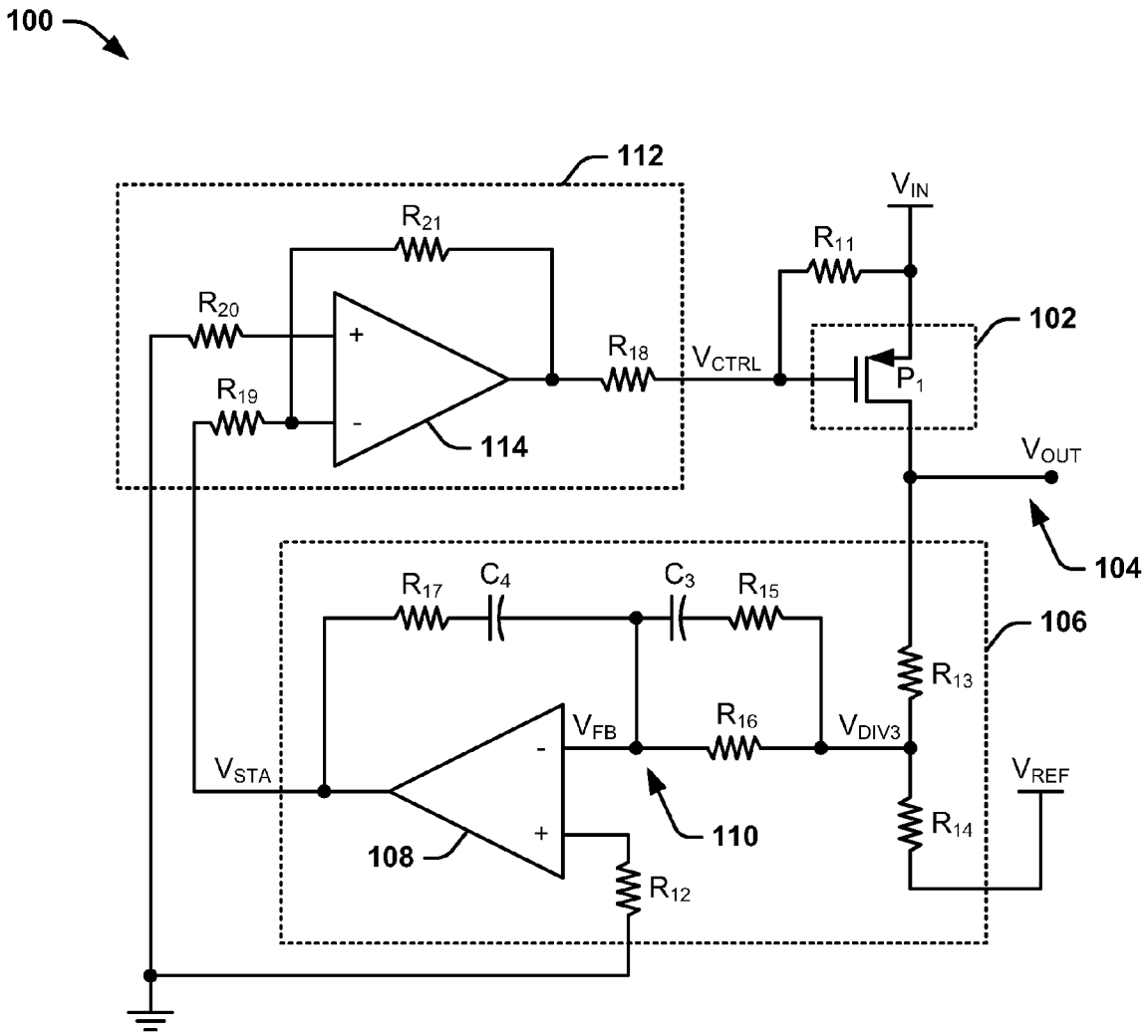
FIG. 3 illustrates another example of an LDO linear power supply circuit in accordance with an aspect of the invention.

FIG. 3 illustrates another example of an LDO linear power supply circuit 100 in accordance with an aspect of the invention. The LDO linear power supply circuit 100 can be included in an IC chip (i.e., IC package). The LDO linear power supply circuit 100 can correspond to the LDO linear power supply 12 in the example of FIG. 1. Therefore, reference can be made to the example of FIG. 1 in the following description of the example of FIG. 3.

The LDO linear power supply circuit 100 is configured to generate an output voltage $V_{OUT}$ that has a magnitude that is substantially proportional to an input voltage $V_{IN}$ through a given range of the input voltage $V_{IN}$. As described in greater detail herein, the output voltage $V_{OUT}$ can be a negative voltage in the example of FIG. 3. As an example, in response to the input voltage $V_{IN}$ decreasing to a magnitude that is less than threshold magnitude, the output voltage $V_{OUT}$ may be provided at an approximately constant minimum magnitude. The LDO linear power supply circuit 100 can be implemented in any of a variety of applications in which the output voltage $V_{OUT}$ is to be provided at a substantially stable magnitude based on the input voltage $V_{IN}$, as described in greater detail herein.

The LDO linear power supply circuit 100 includes a pass element 102, demonstrated in the example of FIG. 3 as a P-channel MOSFET (P-FET) $P_1$. The P-FET $P_1$ is coupled to the input voltage $V_{IN}$ at a source and an output 104 to provide the output voltage $V_{OUT}$ via a drain. In the example of FIG. 3, the P-FET $P_1$ receives a control voltage $V_{CTRL}$ at a gate to control the P-FET $P_1$ in a linear region through a given range of magnitudes of the input voltage $V_{IN}$. A resistor $R_{11}$ interconnects the input voltage $V_{IN}$ and the control voltage $V_{CTRL}$ and provides a desired bias for startup conditions.

The LDO linear power supply circuit 100 also includes a compensation amplifier stage 106 that is coupled to the output 104. The compensation amplifier stage 106 includes a compensation OP-AMP 108 that is configured to generate a stabilization voltage $V_{STA}$ based on being coupled to a low-voltage rail via a resistor $R_{12}$ at a non-inverting input and a feedback voltage $V_{FB}$ at an inverting input coupled to a node 110. Therefore, the compensation OP-AMP 108 is configured as an inverting OP-AMP to provide for fast transient response for slew of the compensation OP-AMP 108. The compensation amplifier stage 106 also includes a set of resistors $R_{13}$ and $R_{14}$ that interconnect the output 104 and a reference voltage $V_{REF}$. The resistors $R_{13}$ and $R_{14}$ form a voltage-divider to generate a voltage $V_{DIV3}$. The feedback voltage $V_{FB}$ is generated at the node 110 based on the voltage $V_{DIV3}$ via a resistive-capacitive feed-forward network formed by a capacitor $C_3$ and a resistor $R_{15}$ and via a resistor $R_{16}$, and based on the stabilization voltage $V_{STA}$ via a resistive-capacitive feedback network formed by a capacitor $C_4$ and a resistor $R_{17}$. Therefore, the feedback voltage $V_{FB}$ is generated based on the output voltage $V_{OUT}$ and the stabilization voltage $V_{STA}$. The compensation OP-AMP 108 thus acts as an error amplifier to generate the stabilization voltage $V_{STA}$ to provide frequency compensation of the LDO linear power supply circuit 100 to affect the frequency response of the stabilization voltage $V_{STA}$, and thus the output voltage $V_{OUT}$, and to provide substantially rapid transient response of the stabilization voltage $V_{STA}$.

The stabilization voltage $V_{STA}$ is provided to a gain amplifier stage 112 that interconnects the pass element 102 and the compensation amplifier stage 106. The gain amplifier stage 112 includes a gain OP-AMP 114 that is configured to generate a control voltage $V_{CTRL}$ via a resistor $R_{18}$. The control voltage $V_{CTRL}$ is provided to a gate of the P-FET $P_1$, such that the P-FET $P_1$ can be operated in a linear region through the given range of magnitudes of the input voltage $V_{IN}$. In the example of FIG. 3, the gain OP-AMP 114 receives the stabilization voltage $V_{STA}$ at an inverting input of the gain OP-AMP 114 via a resistor $R_{19}$ and is coupled to ground at a non-inverting input via a resistor $R_{20}$. In addition, a feedback resistor $R_{21}$ interconnects an output and the inverting input of the gain OP-AMP 114. Therefore, the gain OP-AMP 114 is configured to provide DC gain scaling of the stabilization voltage $V_{STA}$ in generating the control voltage $V_{CTRL}$. As a result, the control voltage $V_{CTRL}$ can exhibit substantially the same frequency response and substantially rapid transient response as the stabilization voltage $V_{STA}$. Accordingly, the P-FET $P_1$ can be operated in a linear region through a given range of magnitudes of the input voltage $V_{IN}$ based on the control voltage $V_{CTRL}$.

It is to be understood that the LDO linear power supply circuit 100 is not intended to be limited to the example of FIG. 3. For example, the LDO linear power supply circuit 100 can be implemented with additional or alternative circuit components to achieve substantially the same desired effects with respect to the compensation stage 106 and/or the gain stage 112. In addition, the pass element 102 is not limited to being implemented as an P-FET, but could instead be implemented as a PNP BJT or a PNP Darlington pair, such that pass element 102 can be controlled by a current provided through the resistor $R_{18}$. Accordingly, the LDO linear power supply circuit 100 can be configured in a variety of ways.

What have been described above are examples of the invention. It is, of course, not possible to describe every conceivable combination of components or method for purposes of describing the invention, but one of ordinary skill in the art will recognize that many further combinations and permutations of the invention are possible. Accordingly, the invention is intended to embrace all such alterations, modifications, and variations that fall within the scope of this application, including the appended claims.

What is claimed is:

1. A low-dropout (LDO) linear power supply system comprising:

a pass-element configured to generate an output voltage at an output based on an input voltage;

a compensation amplifier stage coupled to the LDO output and configured to provide frequency compensation and to generate a stabilization voltage, wherein the compensation amplifier stage comprises:

a compensation operational amplifier (OP-AMP) configured to generate the stabilization voltage at an output of the compensation OP-AMP based on a reference voltage at a first input of the compensation OP-AMP and a feedback voltage representative of the output voltage at a second input of the compensation OP-AMP;

a resistive-capacitive feed-forward network coupled between the LDO output and the second input of the compensation OP-AMP and configured to generate a feed-forward output voltage that is a fraction of the output voltage at the LDO output, wherein the resistive-capacitive feed-forward network comprises a first resistive voltage-divider and a second resistive voltage-divider, the first resistive voltage divider providing a first divided voltage via a first resistor and a first capacitor, the second resistive voltage divider providing a second divided voltage via a second resistor, the first divided voltage and the second divided voltage configured to be combined to generate the feed-forward output voltage; and a resistive-capacitive feedback network coupled between the second input and the output of the compensation OP-AMP and configured to feed back the stabilization voltage to the second input, wherein the feedback voltage generated at the second input of the compensation OP-AMP is generated based on a portion of the stabilization voltage and the feed-forward output voltage; and a gain amplifier stage interconnecting the compensation amplifier stage and the pass-element and configured to generate a control voltage based on the stabilization voltage and which has a frequency response that is approximately equal to a frequency response of the stabilization voltage, the control voltage being provided to the pass element with direct current (DC) gain scaling of the stabilization voltage to generate the output voltage proportional to the input voltage within a given range of the input voltage.

2. The low-dropout (LDO) linear power supply system of claim 1, wherein the pass-element is configured as one of a bipolar junction transistor (BJT), a metal-oxide semiconductor field-effect transistor (MOSFET), and a Darlington pair of transistors.

3. The low-dropout (LDO) linear power supply system of claim 1, wherein the resistive-capacitive feed-forward and feedback networks are configured to cooperate to affect the frequency response of the output voltage.

4. The low-dropout (LDO) linear power supply system of claim 1, wherein the gain amplifier stage comprises a gain OP-AMP configured to receive the stabilization voltage at a first input and to generate the control voltage at an output of the gain OP-AMP.

5. The low-dropout (LDO) linear power supply system of claim 4, wherein the control voltage has a magnitude that is proportional to the stabilization voltage.

6. An integrated circuit (IC) chip comprising the LDO linear power supply system of claim 1.

7. The IC chip of claim 6, wherein the IC chip comprises terminals configured to receive a second capacitor and an associated equivalent series resistance (ESR) coupled to the LDO output external to the IC to provide output filtering of the output voltage.

8. A low-dropout (LDO) linear power supply system comprising:

a pass-element configured to generate an output voltage at an output based on an input voltage;

a compensation amplifier stage coupled to the output and configured to provide frequency compensation and to generate a stabilization voltage in response to a reference voltage and a feedback voltage representative of the output voltage, wherein the compensation amplifier stage comprises:

a compensation operational amplifier (OP-AMP) configured to generate the stabilization voltage at an output of the compensation OP-AMP based on the reference voltage at a first input of the compensation OP-AMP and the feedback voltage at a second input of the compensation OP-AMP:

a resistive-capacitive feed-forward network coupled between the LDO output and the second input of the compensation OP-AMP and configured to generate a feed-forward output voltage that is a fraction of the output voltage at the LDO output, wherein the resistive-capacitive feed-forward network comprises a first resistive voltage-divider and a second resistive voltage-divider, the first resistive voltage divider providing a first divided voltage via a first resistor and a first capacitor, the second resistive voltage divider providing a second divided voltage via a second resistor, the first divided voltage and the second divided voltage configured to be combined to generate the feed-forward output voltage; and a resistive-capacitive feedback network coupled between the second input and the output of the compensation OP-AMP and configured to feedback the stabilization voltage to the second input, wherein the feedback voltage generated at the second input of the compensation OP-AMP is generated based on a portion of the stabilization voltage and the feed-forward output voltage; and a gain amplifier stage interconnecting the compensation amplifier stage and the pass-element and configured to generate a control voltage based on the stabilization voltage and which has a frequency response that is approximately equal to a frequency response of the stabilization voltage, the control voltage being provided to the pass-element with direct current (DC) gain scaling of the stabilization voltage to generate the output voltage proportional to the input voltage; and a second capacitor and an associated equivalent series resistance (ESR) coupled to the output to provide output filtering of the output voltage.

9. The low-dropout (LDO) linear power supply system of claim 8, wherein the resistive-capacitive feed-forward and feedback networks are configured to cooperate to affect the frequency response of the output voltage and to provide substantially rapid transient response of the stabilization voltage.

10. The low-dropout (LDO) linear power supply system of claim 8, wherein the gain amplifier stage comprises a gain OPAMP configured to receive the stabilization voltage at a first input and to generate the control voltage at an output of the gain OP-AMP.

11. An integrated circuit (IC) chip comprising the LDO linear power supply system of claim 8, wherein the IC chip is configured to receive the second capacitor and the ESR as an external capacitor.

12. An integrated circuit (IC) chip comprising a low-dropout (LDO) linear power supply system, the LDO linear power supply system comprising:

a pass-element configured to generate an output voltage at an output based on an input voltage;

a compensation amplifier stage coupled to the LDO output and configured to provide frequency compensation and to generate a stabilization voltage in response to a reference voltage and a feedback voltage representative of the output voltage, wherein the compensation amplifier stage comprises:

a compensation operational amplifier (OP-AMP) configured to generate the stabilization voltage at an output of the compensation OP-AMP based on the reference voltage at a first input of the compensation OP-AMP and the feedback voltage at a second input of the compensation OP-AMP:

a resistive-capacitive feed-forward network coupled between the LDO output and the second input of the compensation OP-AMP and configured to generate a feed-forward output voltage that is a fraction of the output voltage at the LDO output, wherein the resistive-capacitive feed-forward network comprises a first resistive voltage-divider and a second resistive voltage-divider, the first resistive voltage divider providing a first divided voltage via a first resistor and a first capacitor, the second resistive voltage divider providing a second divided voltage via a second resistor, the first divided voltage and the second divided voltage configured to be combined to generate the feed-forward output voltage; and a resistive-capacitive feedback network coupled between the second input and the output of the compensation OP-AMP and configured to feedback the stabilization voltage to the second input, wherein the feedback voltage generated at the second input of the OP-AMP is generated based on a portion of the stabilization voltage and the feed-forward output voltage; and a gain amplifier stage interconnecting the compensation amplifier stage and the pass-element and comprising a gain OP-AMP configured to receive the stabilization voltage at a first input of the gain OP-AMP and to generate a control voltage at an output of the gain OP-AMP, the control voltage being provided to control the pass-element at a control input, the gain amplifier stage being configured to provide direct current (DC) gain scaling of the control voltage relative to the stabilization voltage to control the pass-element to generate the output voltage proportional to the input voltage; and terminals configured to receive a second capacitor and an associated equivalent series resistance (ESR) coupled to the output external to the IC to provide output filtering of the output voltage.

13. A low-dropout (LDO) linear power supply system comprising:

a pass-element configured to generate an output voltage at an output based on an input voltage;

a compensation amplifier stage coupled to the LDO output and configured to provide frequency compensation and to generate a stabilization voltage in response to a reference voltage and a feedback voltage representative of the output voltage, wherein the compensation amplifier stage comprises:

a compensation operational amplifier (OP-AMP) configured to generate the stabilization voltage at an output of the compensation OP-AMP based on the reference voltage at an inverting input of the compensation OP-AMP and the feedback voltage at the inverting input of the compensation OP-AMP:

a resistive-capacitive feed-forward network coupled between the LDO output and the inverting input of the compensation OP-AMP and configured to generate a feed-forward output voltage that is a fraction of the output voltage at the LDO output, wherein the resistive-capacitive feed-forward network comprises a resistive voltage-divider, the resistive voltage divider providing a divided voltage via a first resistor, a second resistor and a first capacitor to generate the feed-forward output voltage; and a resistive-capacitive feedback network coupled between the inverting input and the output of the compensation OP-AMP and configured to feed back the stabilization voltage to the inverting input, wherein the feedback voltage generated at the inverting input of the compensation OP-AMP is generated based on a portion of the stabilization voltage, the feed-forward output voltage and the reference voltage, wherein the reference voltage and the output voltage are directly interconnected by the resistive voltage divider; and an a gain amplifier stage interconnecting the compensation amplifier stage and the pass-element and configured to generate a control voltage based on the stabilization voltage and which has a frequency response that is approximately equal to a frequency response of the stabilization voltage, the control voltage being provided to the pass-element with direct current (DC) gain scaling of the stabilization voltage to generate the output voltage proportional to the input voltage within a given range of the input voltage.

* * * * *